United States Patent [19]

Nagata et al.

[11] Patent Number: 4,544,291

[45] Date of Patent: Oct. 1, 1985

[54] INVERTIBLE INKED RIBBON CARTRIDGE HAVING TWO SETS OF FEED MECHANISMS FOR AN IMPACT-SERIAL PRINTER

[75] Inventors: Muneyoshi Nagata; Hiroshi Kano, both of Tokyo, Japan

[73] Assignee: Nippon Electric Co., Ltd., Japan

[21] Appl. No.: 243,289

[22] Filed: Mar. 13, 1981

[30] Foreign Application Priority Data

Mar. 13, 1980 [JP] Japan ..... 55-31950
Sep. 29, 1980 [JP] Japan ..... 55-135443

[51] Int. Cl.[4] ..... B41J 32/00

[52] U.S. Cl. ..... 400/208; 400/234; 400/235.1

[58] Field of Search ..... 400/194, 195, 196, 196.1, 400/207, 208, 208.1, 219.2, 223, 227, 227.2, 229, 234, 235.1, 249, 219.1; 242/197, 198, 199, 200

[56] References Cited

U.S. PATENT DOCUMENTS

| | | | |
|---|---|---|---|
| 952,281 | 3/1910 | Secor | 400/235.1 |
| 1,198,638 | 9/1916 | Kurowski | 400/234 X |
| 2,986,260 | 5/1961 | Whippo | 400/208 |
| 2,989,261 | 6/1961 | Gilette et al. | 242/198 |
| 3,174,611 | 3/1965 | Lapointe | 400/235.1 X |
| 3,197,151 | 7/1965 | Sparks et al. | 242/200 X |
| 3,411,731 | 11/1968 | Kelley | 242/199 |
| 4,000,804 | 1/1977 | Zaltieri | 400/234 X |
| 4,011,933 | 3/1977 | Kern | 400/208 |
| 4,034,935 | 7/1977 | Plaza et al. | 400/208 X |
| 4,115,013 | 9/1978 | Hedstrom | 400/249 |
| 4,162,774 | 7/1979 | Bowers | 242/199 X |
| 4,213,575 | 7/1980 | Firth, III et al. | 400/249 X |
| 4,264,223 | 4/1981 | Bemis et al. | 400/208 |

OTHER PUBLICATIONS

Xerox Disclosure Journal, "Ribbon Advance Mechanism", Mikes, vol. 2, No. 4, Jul./Aug. 1977, p. 47.

IBM Technical Disclosure Bulletin, "Constant-Tension Ribbon Cartridge", Bullock et al., vol. 23, No. 5, Oct. 1980, pp. 1741-1742.

*Primary Examiner*—Ernest T. Wright, Jr.

*Attorney, Agent, or Firm*—Sughrue, Mion, Zinn, Macpeak, and Seas

[57] ABSTRACT

An inked ribbon cartridge has two sets of ribbon feed mechanisms, one for each core means around which the ribbon is wound, allowing the ribbon to travel back and forth so that the cartridge can be loaded upside down when the upper half of the ribbon has been used up thereby doubling the useful life of the cartridge. Two springs apply a predetermined force to two ratchet wheels which are connected to first and second core means for preventing an over-rotation of the core means. Each feed mechanism comprises a feed driven roller and a feed drive roller.

9 Claims, 11 Drawing Figures

FIG. 3
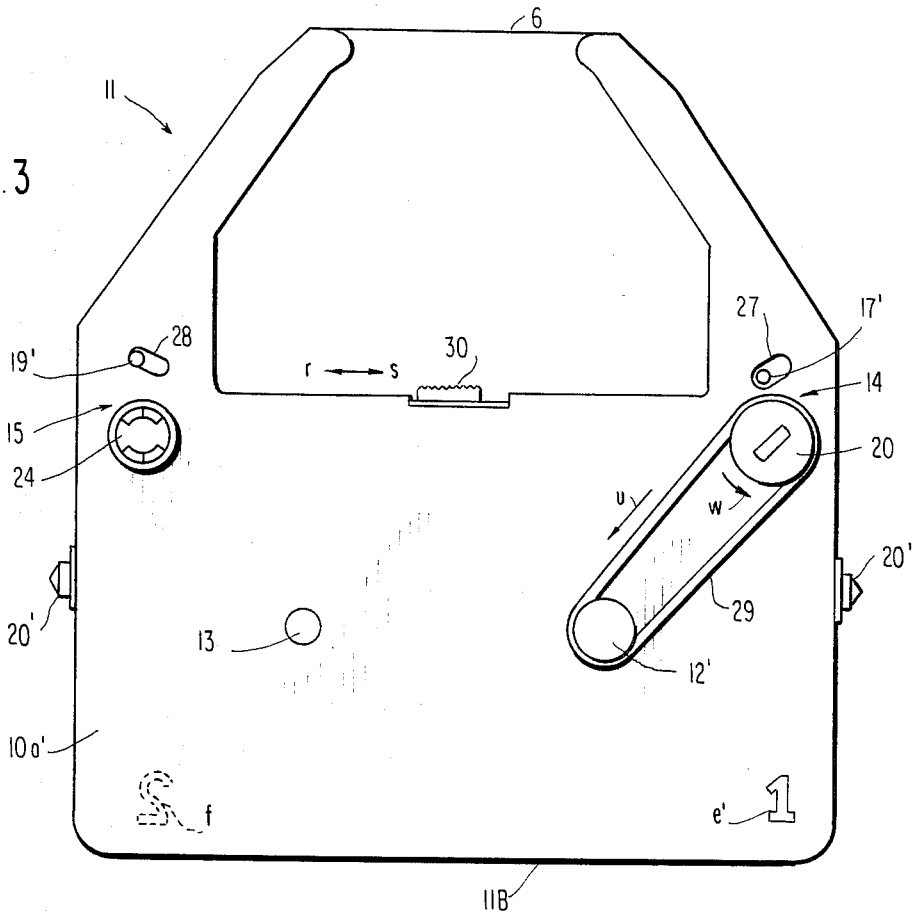
FIG. 4
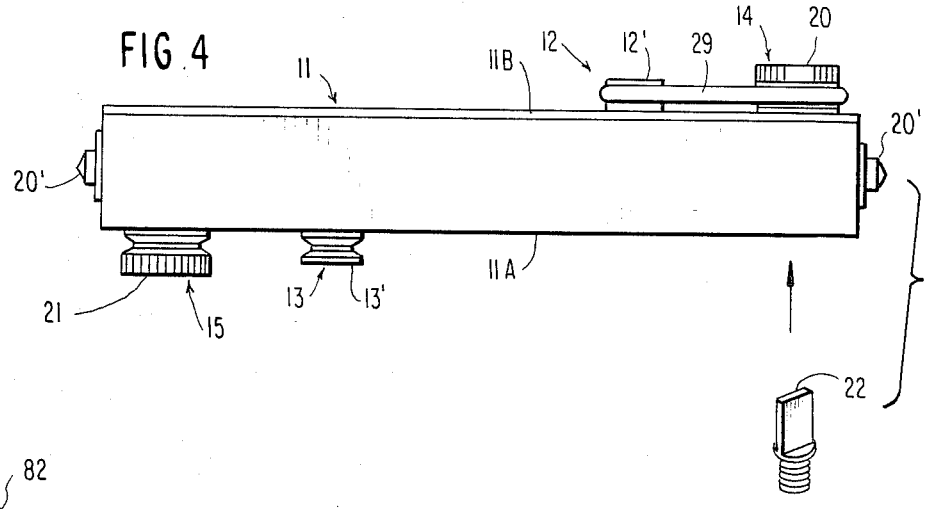
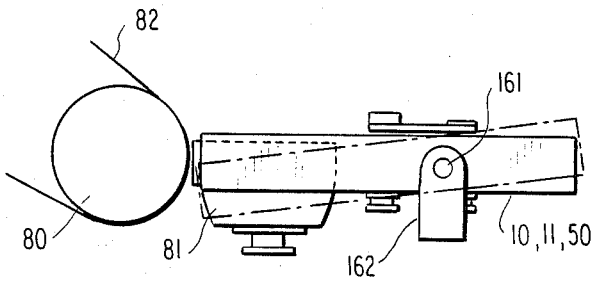
FIG. 11

INVERTIBLE INKED RIBBON CARTRIDGE HAVING TWO SETS OF FEED MECHANISMS FOR AN IMPACT-SERIAL PRINTER

The present invention relates to an inked ribbon cartridge for an impact-serial printer, and more particularly to a film ribbon cartridge for use in an impact-serial printer or electronic typewriter which is required to have a high quality.

Heretofore, serial printers have used an inked ribbon such as a cloth ribbon and a carbon film ribbon, and recently in order to improve the lifetime of the inked ribbon, the inked ribbon has been contained in a cartridge. To obtain a high printing quality a carbon film ribbon has been contained in the cartridge. However, in view of the nature of the film, it is impossible to form a cartridge having an endless structure which could be repeatedly used for printing as is the case with the inked cloth ribbon. Accordingly, in the case of a film ribbon cartridge, the life of the ribbon is extremely short as compared to a cloth ribbon cartridge, and hence it has a disadvantage in that the cost of the ribbon is high.

It is therefore an object of the present invention to provide an inked ribbon cartridge in which the life of the inked ribbon is extended.

According to the present invention, there is provided an inked ribbon cartridge comprising:

an inked ribbon for use in printing by an impact-printer;

a casing for housing said inked ribbon;

first and second core means rotatably supported by said casing, terminal ends of said inked ribbon being secured to said first and second core means, said inked ribbon being wound around said first and second core means;

first and second feed drive means for feeding said inked ribbon from one of said first and second core means to the other; and means for transmitting a rotational motion of said drive means to at least one of said first and second core means.

Other features and advantages of the present invention will be apparent from the following description of preferred embodiments of the present invention taken in conjunction with the accompanying drawing, wherein;

FIG. 3 is a plan view of a second embodiment of the present invention;

FIG. 4 is a side view of the second embodiment shown in FIG. 3;

FIG. 11 shows a state where the ribbon cartridge according to the embodiments has been loaded in a printer.

Figure 1:
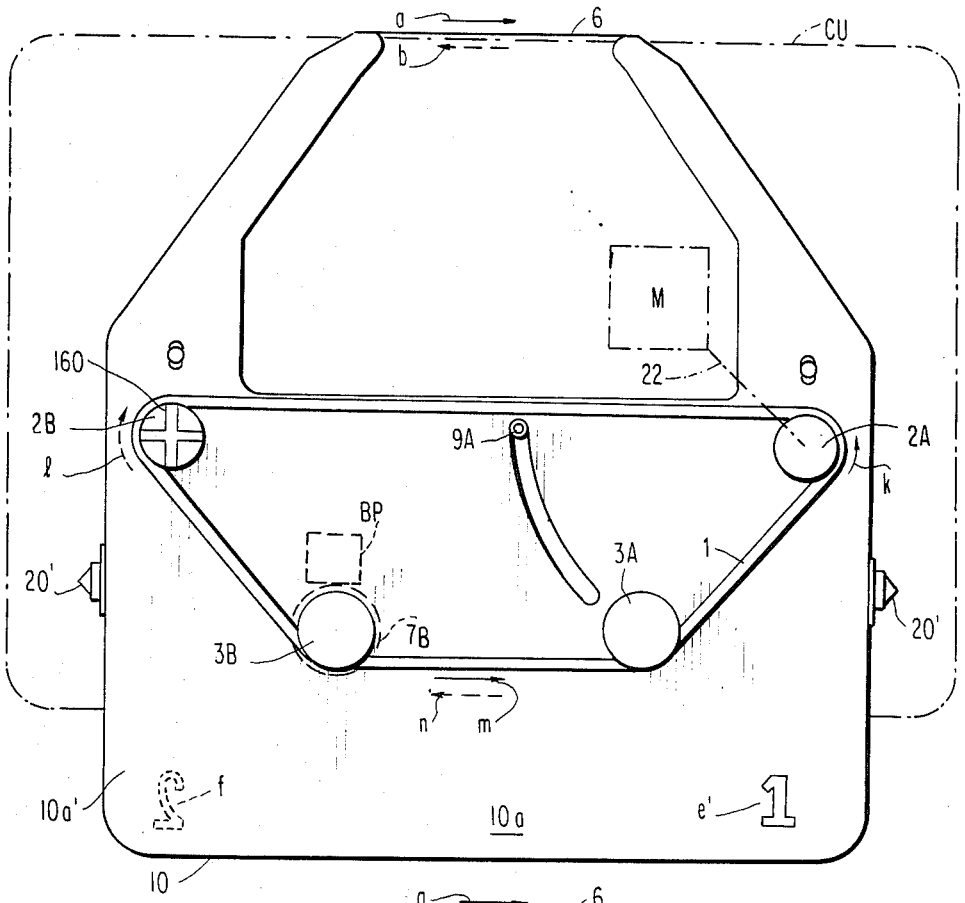
FIG. 1 is a plan view of a first embodiment of the present invention.
Figure 2:
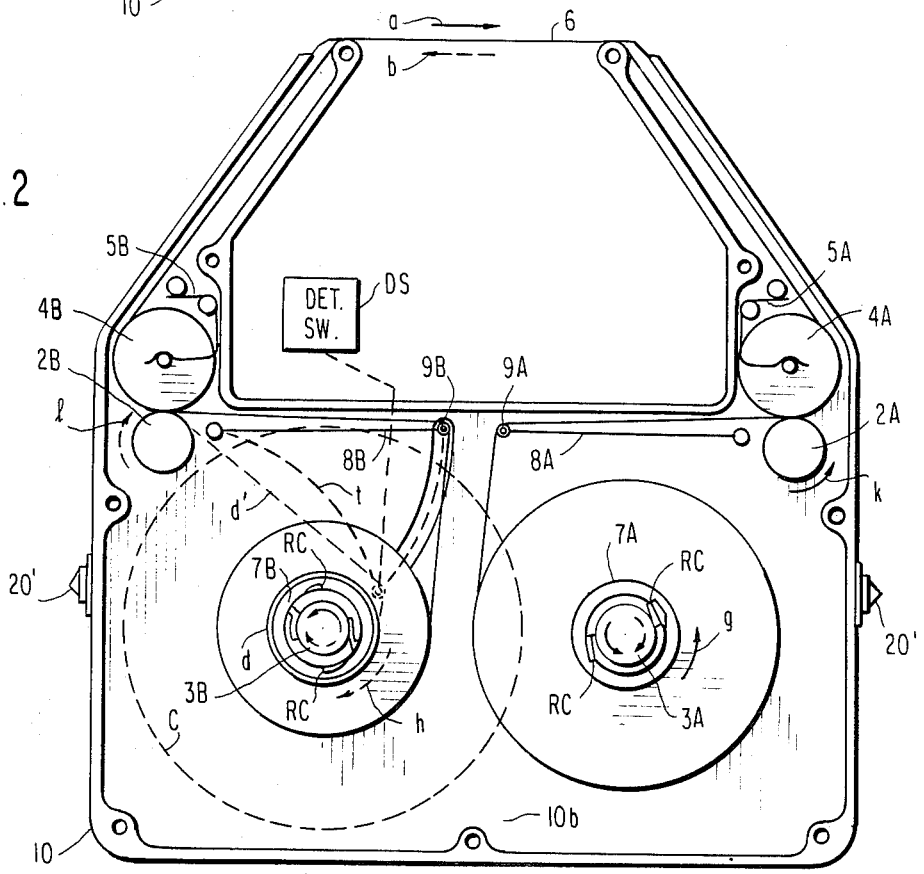
FIG. 2 is a plan view of the first embodiment shown in FIG. 1 with a cover removed.

Referring to FIGS. 1 and 2, feed drive rollers 2A and 2B and cores 3A and 3B are rotatably supported on an inked ribbon cartridge 10 so as to penetrate a front cover 10*a* of the cartridge 10. A rubber belt 1 is engaged with the feed drive rollers 2A and 2B and the cores 3A and 3B on the outside of the front cover 10*a*, as shown in FIG. 1. Idle rollers 4A and 4B placed inside the cover 10*a* are pressed against the feed drive rollers 2A and 2B by means of springs 5A and 5B made of piano wires, respectively, with an inked ribbon 6 pinched therebetween, as shown in FIG. 2, and thereby a ribbon feed mechanism is constructed. The terminal ends of the ribbon 6 are fixedly secured to sleeves 7A and 7B, respectively, which are mounted around the core 3A and 3B via ratchet clutches RC so that rotation in one direction only may be transmitted. Accordingly, upon rotation of the core 3A in the direction indicated by arrow g, the sleeve 7A rotates integrally with the core 3A, but upon rotation in the opposite direction to that indicated by arrow g, the sleeve 7A rotates independently. Likewise, upon rotation of the core 3B in the direction indicated by arrow h, the sleeve 7B rotates integrally with the core 3B, but upon rotation in the opposite direction to that indicated by arrow h, the sleeve 7B rotates independently.

When the inked ribbon cartridge 10 is loaded in a carrier unit CU (not shown) of a serial printer with the front cover surface 10*a* having an indication mark e′ of "1" placed on the front side, the feed drive roller 2A is engaged with a ribbon drive shaft (shown in FIG. 4 as component 22) in the carrier unit of the serial printer on the back cover surface 10*b* of the ribbon cartridge 10 (the surface having an indication mark f of "2" imprinted). As a torque in the direction indicated by arrow k is transmitted to the feed drive roller 2A, the rubber belt 1 travels in the direction indicated by solid line arrow m. Accordingly, the core 3A rotates in the direction indicated by arrow g, and the ribbon 6 is pulled in the direction indicated by arrow a and taken up by the sleeve 7A. As the coil diameter of the ribbon 6 being taken up is increased, slip arises between the core 3A and the belt 1, the ribbon 6 is continuously taken up while controlling a take-up tension by means of a tension arm 8A made of a piano wire.

On the other hand, because the feed drive roller 2B and the core 3B are rotated in the counter-clockwise direction, the sleeve 7B can rotate independently of the rotation of the core 3B in the counter-clockwise direction, and a frictional force is applied to the sleeve 7B for preventing its overrotation by a braking pad BP (provided on the inside of the front cover 10*a*), whereby the ribbon 6 wound around the sleeve 7B can be payed out under an appropriate tension. When the pay-out operation has reached the terminal end of the ribbon 6, since the terminal end of the ribbon 6 is fixedly secured to the sleeve 7B, a tension arm 8B made of a piano wire is flexed as indicated by a dashed line t in FIG. 2, and hence, movement of a tip end 9B of the tension arm 8B, (or 9A of tension arm 8A) is used for detecting the arrival at the terminal end of the ribbon 6. It is possible to stop the printing operation of the serial printer in response to the actuation of the ribbon end detector switch DS.

In this way, an unused ribbon 6 is started to be payed out from the state indicated by a dashed line circle c in FIG. 2 (illustration is made only on the side of the sleeve 7B) and is fed at a predetermined pitch each time printing is effected while the upper half width of the ribbon 6 is being used for printing. Upon detection of the arrival at the terminal end, the ribbon 6 would have been used up to the state indicated by a line d'. The letter d represents an amount of ribbon 6 wrapped around sleeve 7B required to secure the ribbon 6 to the sleeve.

Thereafter, the ribbon cartridge 10 is loaded upside down in the carrier unit (the back cover surface having an indication mark f of "2" comes to the front side), and a cross slot 160 on the feed drive roller 2B is engaged with the ribbon drive shaft. As a result, a torque in the direction indicated by arrow l is transmitted to the feed drive roller 2B, whereby the rubber belt 1 travels on the outside of the front cover of the cartridge 10 in rotation in the direction indicated by dashed line arrow n, and the ribbon 6 is fed in the direction represented by arrow b and taken up by the core 3B. During this process, the unused section of the ribbon 6 which was located in the lower half width before the upside-down loading is held in the position for printing.

In this way, the ribbon 6 is moved back and forth and the upper and lower half widths of the ribbon 6 are respectively used for printing.

Referring to FIGS. 3-7, according to the second embodiment a ribbon cartridge 11, within a cartridge casing 11A accomodates a film ribbon 6. The film ribbon 6 is wound on takeup/payout mechanisms 12 and 13, and further it is adapted to be made to travel by ribbon feed mechanisms 14 and 15. On the front cover surface (the side indicating numeral "1" in FIG. 3) of the ribbon cartridge 11 is provided a pulley 20 of the ribbon feed mechanism 14 and a pulley 12' of the take-up/pay-out mechanism 12. These pulleys 20 and 12' engage a belt 29. Likewise, on the back surface (the side indicating numeral "2" in FIG. 3) of the ribbon cartridge 11 is provided a pulley 21 of the feed mechanism 15 and a pulley 13' of the take-up/pay-out mechanism 13, on which a belt identical to the belt 29 is engaged.

The ribbon feed mechanism 14 has a coupling section 23 (FIG. 6) to be engaged with a feed drive shaft 22 (FIG. 4) at the back cover surface f, (the side indicating the numeral "2" in FIG. 3) in order that the film ribbon 6 is made to travel by the rotation of the feed drive shaft 22. When the ribbon feed mechanism 14 is driven into rotation, the pulley 20 rotates in the direction indicated by an arrow (v in FIG. 3), and the belt 29 is also similarly driven in the direction indicated by an arrow u to rotate the pulley 12', whereby the take-up/pay-out mechanism 12 takes up the film ribbon 6. Likewise, the ribbon feed mechanism 15 has a coupling section 24 to be engaged with the drive shaft 22 at the front surface (the side indicating the numeral "1" in FIG. 3) so as to be used in the case where the ribbon cartridge 11 is inverted.

A holding mechanism 30 serves to hold the ribbon feed mechanisms 14 and 15 at predetermined positions, and displacement of the holding mechanism 30 in either direction of the directions indicated by arrows r and s (FIGS. 3 and 5) causes feed driven rollers 17 and 19 to move along elongated holes 27 and 28 in the cartridge 11 and thereby to bring one of the ribbon feed mechanisms 14,15 into an active state.

Figure 5:
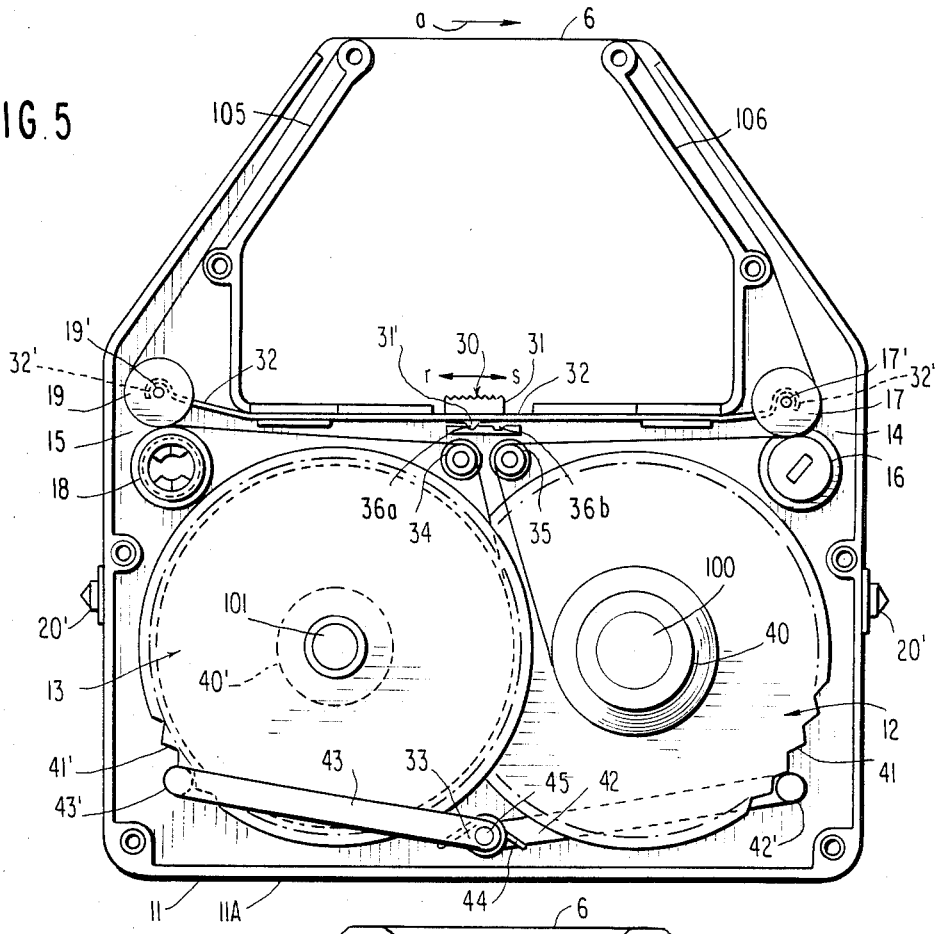
FIG. 5 is a plan view of the second embodiment with a cover removed.

Referring to FIG. 5, the ribbon cartridge 11 accommodates the film ribbon 6, the take-up/pay-out mechanisms 12 and 13 having the opposite end portions of the film ribbon 6 wound therearound, the ribbon feed mechanisms 14 and 15 for making the film ribbon 6 travel, the holding mechanism 30 for holding the ribbon feed mechanisms 14,15 in an active state or in an inactive state, an overrotation preventing mechanism 33 for preventing rotation of the ribbon take-up/pay-out mechanisms 12 and 13 (FIG. 7), and idle rollers 34 and 35 for extending the film ribbon 6 therearound.

The ribbon take-up/pay-out mechanism 12 includes a ratchet wheel 41 and a core 40 engaged with the shaft 100 of the ratchet wheel 41, while the take-up/pay-out mechanism 13 includes a ratchet wheel 41' and a core 40' engaged with the shaft 100 (FIG. 6) of the ratchet wheel 41'. To the cores 40 and 40' are fixedly secured the respective portions of the film ribbon 6 so that the film ribbon 6 is wound around them. These cores 40 and 40' are removable from the ratchet wheels 41 and 41', respectively, for the purpose of replacement of the film ribbon 6. The take-up/pay-out mechanisms 12 and 13 have their shafts 100 and 101 pivotally supported by the cover 11B on the front surface and the casing 11A on the back surface, so that they can be freely rotated. In addition, the take-up/pay-out mechanisms 12 and 13 are provided with the pulleys 12' and 13', respectively, on their shafts 100,101 (FIG. 6) so that belts 29 can be engaged therewith.

The ribbon feed mechanism 14 includes a feed drive roller 16 and a feed driven roller 17, and the ribbon feed mechanism 15 includes a feed drive roller 18 and a feed driven roller 19. The feed drive roller 16 (18) has a pulley 20 (21) at one end and a coupling section 23 (24) (shown in FIGS. 6 and 3, respectively) to be engaged with a feed drive shaft 22 at the other end. The feed driven roller 17 (19) has a shaft 17' (19') which is engaged with an elongated hole 27 (28) provided in the cartridge casing 11A and the cover 11B. The holding mechanism 30 is composed of a knob 31 having a holding capability and a spring 32 secured thereto. A protrusion 31' of the knob 31 is adapted to be engaged with either one of two recesses 36*a* and 36*b* to hold the spring 32 in position. The spring 32 is engaged at its opposite ends with the feed driven rollers 17 and 19. In response to movement of the knob 31 in the direction of arrow r or s, the feed driven rollers 17 and 19 have their shafts 17' and 19' respectively, displaced along the elongated holes 27 and 28. For instance, in the case of moving the knob 31 in the direction of arrow r, since the feed driven roller 17 is brought close to the feed drive roller 16 along the elongated hole 27, the feed driven roller 17 makes contact with the feed drive roller 16 and is urged thereby by the spring 32. Accordingly, the film ribbon 6 is pinched between the feed drive roller 16 and the feed driven roller 17, so that the ribbon feed mechanism 14 now holds the film ribbon 6 in a state where it can travel. On the other hand, since the feed driven roller 19 is brought apart from the feed drive roller 18 along the elongated hole 28, the ribbon feed mechanism 15 holds the film ribbon 6 in a free state.

Figure 6:
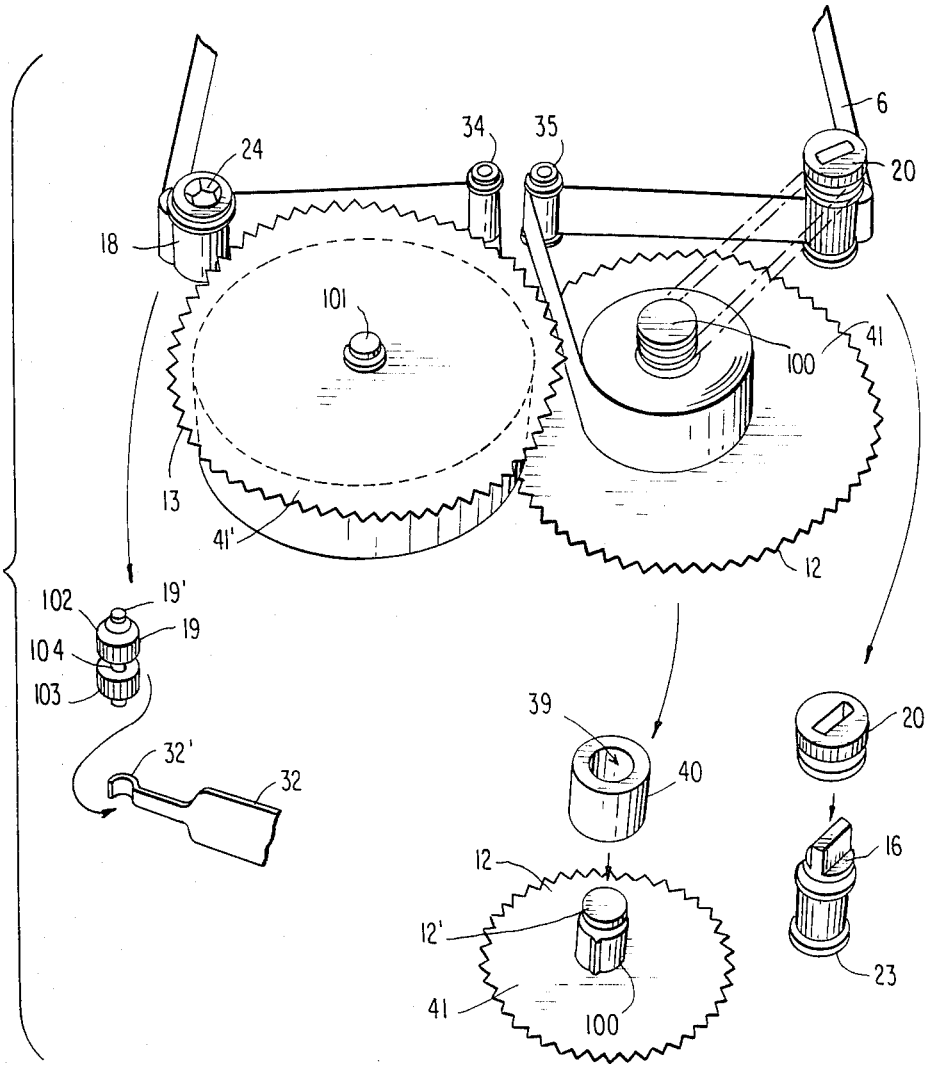
FIG. 6 is an exploded view of essential portions of the second embodiment.

Referring to FIG. 6, the take-up/pay-out mechanism 12 includes the core 40 for winding the film ribbon 6 therearound, and the ratchet wheel 41 having the shaft 100 adapted to fit into a hole 39 in the core 40. On the shaft 100 of the ratchet wheel 41 is mounted the pulley 12' as described above. The take-up/pay-out mechanism 13 is identical to the mechanism 12.

The feed drive rollers 16 and 18 in the ribbon feed mechanisms 14 and 15, respectively, have pulleys 20 and 21 and coupling sections 23 and 24 mounted coaxially thereon. In addition, the feed driven rollers 17 and 19 have their roller sections divided into two parts 102,103, respectively, and the central section 104 of the rollers 17, 19 have a structure adapted to be engaged with a tip end 32' of the spring 32 (see FIG. 6).

Figure 7:
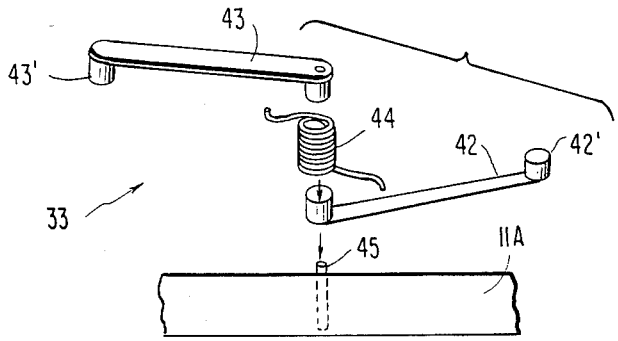
FIG. 7 is an exploded view of an over-rotation preventing mechanism employed in the second embodiment.

Referring to FIG. 7, the over-rotation preventing mechanism 33 has such structure that one end of arms 42 and 43 is fitted around a shaft 45 provided on the cartridge casing 11A, and also a spring 44 is fitted around the shaft 45 and is interposed between the ends of the arms 42 and 43. The arms 42 and 43 are engaged at their central portions with the spring 44, so that torques directed in the opposite directions to each other are exerted upon the arms 42 and 43, respectively. The arms 42 and 43 are provided with protrusions 42' and 43', respectively, at the other ends thereof, and these protrusions 42' and 43' are engaged with the teeth of the ratchet wheels 41 and 41', respectively. Accordingly, the take-up/pay-out mechanisms 12 and 13 are subjected to braking actions, whereby their rotation is prevented.

Now description will be made on the travelling of the film ribbon. The film ribbon 6 has been extended from the take-up/pay-out mechanism 13 over the idle roller 34, then passed through a clearance between the feed drive roller 18 and the feed driven roller 19 of the ribbon feed mechanism 15, and led externally through one tip end arm 105 of the ribbon cartridge 11, that is, to a printing position. Furthermore, the film ribbon 6 is led from the printing position through the other tip end arm 106 of the ribbon cartridge 11 to the interior of the cartridge 11, passed through a clearance between the feed drive roller 16 and the feed driven roller 17 of the ribbon feed mechanism 14, and extended over the idle roller 35 to be wound around the core 40 of the take-up/pay-out mechanism 12. Subsequently, by moving the knob 31 in the direction of arrow $\gamma$, the protrusion 31' of the knob 31 is engaged with the recess **36*a*, so that the ribbon feed mechanisms 14 and 15 are held in an active state and in inactive state, respectively. Accordingly, in the ribbon feed mechanism 14, when the feed driven roller 17 moves leftwards, the shaft 17' is displaced along the elongated hole 27 in the ribbon cartridge 11 and urges the feed driven roller 17 against the feed drive roller 16, whereby the film ribbon travel is established. In the ribbon feed mechanism 15, since the shaft 19' of the feed driven roller 19 is displaced leftwards along the elongated hole 28 in the ribbon cartridge 11, the feed driven roller 19 is separated from the feed drive roller 18, resulting in the state where the film ribbon 6 is not urged by the feed driven roller 19**.

In using the ribbon cartridge 11, the feed driven roller 16 is driven into rotation by the feed drive shaft 22. Thus the film ribbon 6 travels in the directions of arrow a owing to the cooperative action of the feed drive roller 16 and the feed driven roller 17. The film ribbon 6 is passed over the idle roller 35 and fed to the take-up/pay-out mechanism 12. Since the take-up/pay-out mechanism 12 is driven via the pulley 20, belt 29 and pulley 12' in response to the drive torque of the feed drive shaft 22, the film ribbon 6 can be taken up by the mechanism 12. It is to be noted that although the take-up/pay-out mechanism 12 has the protrusion 42' of the arm 42 engaged with the ratchet wheel 41 and applied with the resilient force of the spring 44, it rotates against the braking action.

On the other hand, in the ribbon feed mechanism 13, since the film ribbon 6 is pulled via the ribbon feed mechanism 15 and the idle roller 34, the film ribbon 6 is payed out from the mechanism 13 in response to the pulling action.

Figure 8:
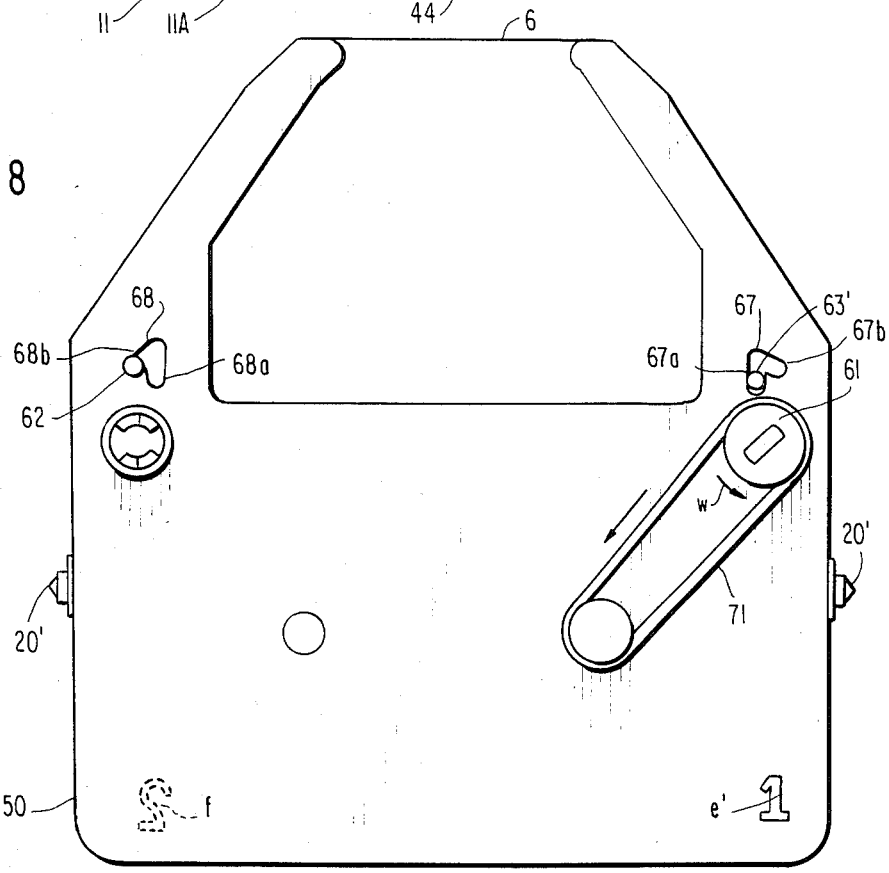
FIG. 8 is a plan view of a third embodiment of the present invention.
Figure 9:
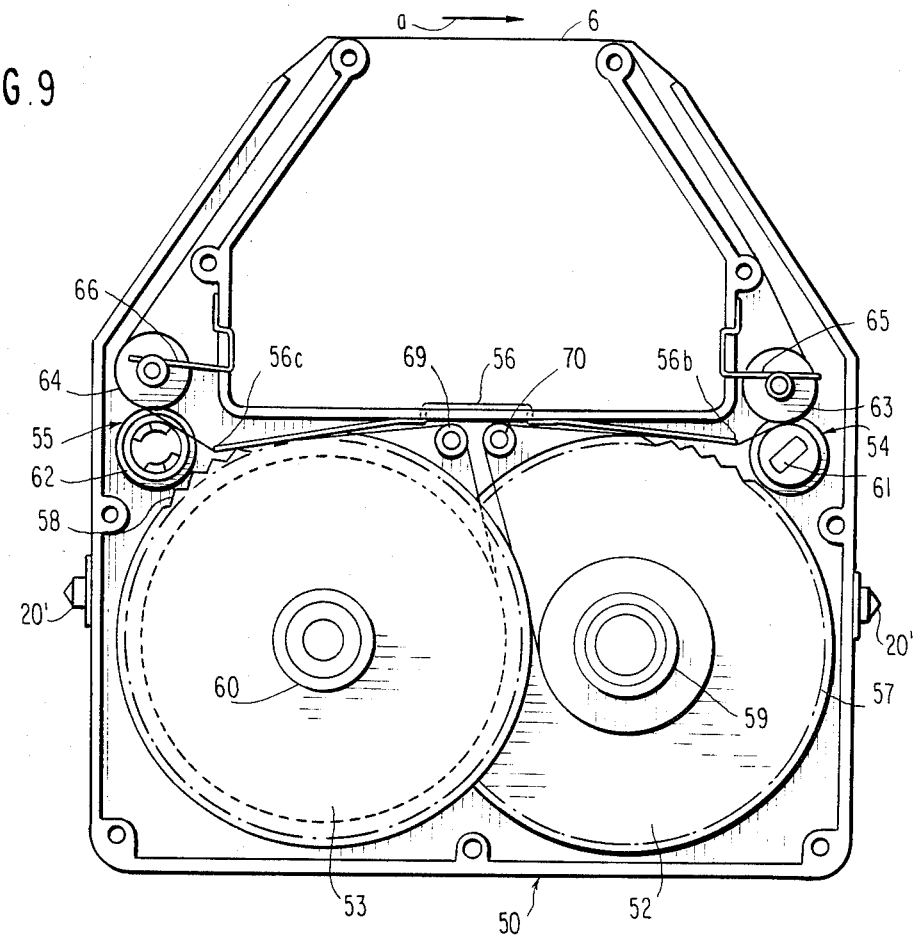
FIG. 9 is a plan view of the third embodiment with a cover removed.

Referring to FIGS. 8 and 9, a ribbon cartridge 50 according to a third embodiment accommodates therewithin a film ribbon 6, take-up/pay-out mechanisms 52 and 53 for winding the film ribbon 6 therearound, ribbon feed mechanisms 54 and 55, and an over-rotation preventing mechanism 56 for preventing rotation of the take-up/pay-out mechanisms 52 and 53.

The take-up/pay-out mechanisms 52 and 53 have the same structure as those employed in the second preferred embodiment, and respectively include ratchet wheels 57 and 58, and cores 59 and 60 which are to be engaged with the ratchet wheels 57,58. The ribbon feed mechanisms 54 and 55 respectively include feed drive rollers 61 and 62 and feed driven rollers 63 and 64. The feed driven rollers 63 and 64 are urged against the feed drive rollers 61 and 62, respectively, by means of springs 65 and 66. The feed driven rollers 63 and 64 respectively have shafts 63' and 64' (FIG. 8), which are slidably engaged with inverse-V-shaped elongated holes 67 and 68, respectively, which have grooves **67*a* and 67*b* and grooves 68*a* and 68*b*, respectively. In the case where the shafts 63' and 64' of the feed driven rollers 63 and 64 are engaged with the grooves 67*a* and 68*a*, respectively, the feed driven rollers 63 and 64 are urged against the feed drive rollers 61 and 62, and in the case where the shafts 63' and 64' are engaged with the grooves 67*b* and 68*b*, the feed driven rollers 63 and 64 are released from being urged against the feed drive rollers 61 and 62, respectively. It is to be noted that the feed driven rollers 63 and 64 can be manipulated independently and individually. Accordingly, the ribbon feed mechanisms 54 and 55 allow the film ribbon 6 to travel when the feed driven rollers 63 and 64 are urged against the feed drive rollers 61 and 62**, respectively.

Figure 10:
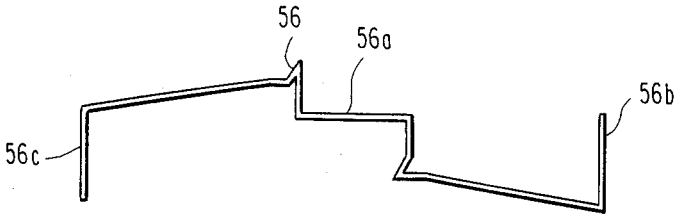
FIG. 10 is a perspective view of an over-rotation preventing mechanism employed in the third embodiment.

The over-rotation preventing mechanism 56 is made of a spring wire as shown in FIG. 10, the central portion **56*a* thereof is mounted on the cartridge 50, one end portion 56*b* is engageable with the ratchet wheel 57 to prevent the ratchet wheel 57 from rotating, and the other end portion 56*c* is engageable with the ratchet wheel 58 to prevent the ratchet wheel 58** from rotating.

As shown in FIG. 8, the cartridge 50 has the structure in which a pulley is provided on the shaft of the feed drive roller 61 and another pulley is provided in the ribbon take-up/pay-out mechanism 52, and these pulleys are coupled by means of a belt 71. This structure is identical to that employed in the second embodiment.

The film ribbon 6 is payed out from the take-up/pay-out mechanism 53, then the passed over an idle roller 69 and the end portion **56*c* of the spring 56, and further led to the outside of the cartridge 50 via the ribbon feed mechanism 55. Still further, the film ribbon 6 led from the outside of the cartridge 50, is passed through the ribbon feed mechanism 54, then passed over the end portion 56*b* of the spring 56 and an idle roller 70, and taken up by the take-up/pay-out mechanism 52**.

Now description will be made on the travelling of the film ribbon 6. Preliminarily in the ribbon feed mechanism 54, the shaft 63' of the feed driven roller 63 is set on the side of the groove **67*a* to bring the ribbon 6 into the state where it can be driven, and in the ribbon feed mechanism 54, the shaft 64' of the feed driven roller 64 is set on the side of the groove 68*b* to bring the film ribbon 6** into the state where it can be passed freely.

Under the above-mentioned state, when the ribbon feed mechanism 54 is driven, the film ribbon 6 is pinched between the feed drive roller 61 and the feed driven roller 63, and hence it is made to travel. As the pulley provided on the shaft of the feed drive roller 61 rotates in the direction of the circular arrow w in FIG. 8 due to the drive of the feed drive roller 61, the pulley provided in the ribbon take-up/pay-out mechanism 52 is rotated via the belt 71. Consequently, the take-up/pay-out mechanism 52 rotates and takes up the ribbon 6. The film ribbon 6 on the side pulled by the ribbon feed mechanism 54 can be subjected to an appropriate tension owing to the over-rotation preventing mechanism 56 on the side of the take-up/pay-out mechanism 53. More particularly, in the take-up/pay-out mechanism 53, the teeth of the ratchet wheel 58 intermesh with the spring end 56c in the over-rotation preventing mechanism 56, and thereby the rotation of the ratchet wheel 58 is prevented. However, in response to the film ribbon 6 being pulled, the end portion 56c of the spring 56 is separated from the ratchet wheel 58, so that the ratchet wheel 58 rotates and pays out the film ribbon 6. Thereupon the end portion 56c of the spring 56 again intermeshes with the ratchet wheel 58 so as to prevent the film ribbon 6 from travelling, and thereby an appropriate tension is applied to the film ribbon 6.

Referring to FIG. 11, the ribbon cartridge 10, 11 or 50 according to the present invention is loaded in a printer apparatus in such a manner that film ribbon 6 may be positioned between a platen 80 having a paper sheet 82 set thereon and a printing head 81, and thereby the printer apparatus is brought into the state where printing can be effected.

The setting of the ribbon cartridge 10 (11 or 50) is effected in such a manner that the studs 20' on the cartridge 10, 11 or 50 may be engaged with holes 161 of two posts 162 in the impact printer or in the typewriter. It is to be noted that the studs 20' serve as pivots for allowing the ribbon cartridge 10, 11 or 50 to swing between a printing position represented by solid lines and a retraction position represented by dash-dot lines. However, the driving mechanism for this motion is not directly related to the present invention, and so, further description thereof will be omitted.

As described above, according to the present invention, the width of a film ribbon 6 is effectively divided into halves, and once the upper half width section thereof has been consumed, the ribbon cartridge 10, 11 or 50 is inverted to dispose the original lower half width section on the upper side, and thereby the original lower half width section can be consumed because the direction of feed of the ribbon 6 is also reversed. Therefore, back and forth feeding can be achieved over the entire length of the film ribbon 6.

Moreover, although the second and third embodiments have been described separately, a similar effect can be achieved even if the respective mechanisms employed in the third embodiment, for instance, are used in the second embodiment as replaced for the corresponding mechanism.

As described above, since the essence of the present invention exists in the ribbon cartridge provided with two sets of ribbon feed mechanisms so as to be loaded upside down, it has become possible to use the ribbon cartridge for printing while the ribbon is travelling back and forth, and therefore, the invention has the effect of doubling the life of the ribbon.

What is claimed is:

1. An inked ribbon cartridge comprising:

an inked ribbon for use in printing by an impact-printer;

a casing for housing said inked ribbon, said casing having first and second surfaces;

first and second core means rotatably supported by said casing, terminal ends of said inked ribbon being secured to said first and second core means, said inked ribbon being wound around said first and second core means;

first and second feed drive means spaced from said first and second core means, said first and second feed drive means being spaced laterally apart from one another, said first and second feed drive means being respectively associated with said first and second core means for alternately feeding said inked ribbon towards its associated core means;

first coupling means on said first feed drive means for coupling with the printer to transmit rotational power through said first surface of said casing; and second coupling means on said second feed drive means for coupling with the printer to transmit rotational power through said second surface of said casing when said cartridge is inverted;

wherein each of said first and second feed drive means includes first and second feed drive rollers, first and second feed driven rollers, and spring means for pressing said first and second feed driven rollers against said first and second feed drive rollers, respectively, said inked ribbon being pinched between at least one of said feed drive rollers and said corresponding feed driven roller.

2. An inked ribbon cartridge as claimed in claim 1 wherein said first core means includes first sleeve means mounted around said first core means, said first sleeve means rotating in a first direction integrally with said first core means and in a second direction independently; and said second core means includes second sleeve means mounted around said second core means, said second sleeve means rotating in said second direction integrally with said second core means and in said first direction independently, said inked ribbon being wound around said first and second sleeve means.

3. An inked ribbon cartridge as claimed in claim 1 further comprising means for releasing said spring means so that said at least one of said feed driven rollers does not press against said corresponding feed drive roller.

4. An inked ribbon cartridge as claimed in claim 1 further comprising means for preventing an over-rotation of said first and second core means.

5. An inked ribbon cartridge as claimed in claim 4 wherein said over-rotation prevention means comprises two ratchet wheels coupled to said first and second core means, and at least one spring for applying a predetermined tension to said ratchet wheels.

6. An inked ribbon cartridge as claimed in claim 4 wherein said over-rotation preventing means comprises a shaft located on said cartridge casing, first and second rotation preventing arms fitted around said shaft, and a rotation preventing spring fitted around said shaft and being interposed between ends of said rotation preventing arms so as to be engageable with said rotation preventing arms to provide torque selectively thereto, said overrotation arms having protrusions at opposite ends thereof which engage teeth on ratchet wheels of said first and second core means, respectively, said overrotation preventing means providing a braking action to said ratchet wheels to prevent rotation thereof.

7. An inked ribbon cartridge as claimed in claim 4 wherein said overrotation preventing means comprises a spring wire having a central portion mounted on said cartridge and having opposite end portions engaged with said first and second core means, respectively.

8. An inked ribbon cartridge as claimed in claim 1 further comprising a holding mechanism (30) connected to said feed driven rollers of said first and second feed drive means by a spring, said holding mechanism being slidable linearally between first and second positions along a path interconnecting said feed driven rollers to selectively engage one or the other of said feed driven rollers with one of said feed drive rollers, said feed driven rollers being movable in separate elongated holes, said feed driven rollers each having upper and lower parts and a central part therebetween, said central part being engageable with opposite tip ends of said spring of said holding mechanism.

9. An inked ribbon cartridge comprising:

an inked ribbon for use in printing by an impact-printer;

a casing for housing said inked ribbon, said casing having first and second surfaces;

first and second core means rotatably supported by said casing, terminal ends of said inked ribbon being secured to said first and second core means, said inked ribbon being wound around said first and second core means;

first and second feed drive means spaced from said first and second core means, said first and second feed drive means being spaced laterally apart from one another, said first and second feed drive means being respectively associated with said first and second core means for alternately feeding said inked ribbon towards its associated core means;

first coupling means on said first feed drive means for coupling with the printer to transmit rotational power through said first surface of said casing;

second coupling means on said second feed drive means for coupling with the printer to transmit rotational power through said second surface of said casing when said cartridge is inverted; and first and second tension arms for maintaining tension in said inked ribbon as said inked ribbon is fed by either of said first and second drive means, at least one of said drive means causing one of said tension arms to flex when said ribbon is fully unwound from one of said core means which actuates a detection switch in said impact printer.

* * * * *

UNITED STATES PATENT AND TRADEMARK OFFICE

CERTIFICATE OF CORRECTION

PATENT NO. : 4,544,291

DATED : October 1, 1985

INVENTOR(S) : Muneyoshi NAGATA, et al

It is certified that error appears in the above-identified patent and that said Letters Patent is hereby corrected as shown below:

Column 3, line 44, "surface f (the side" should read --surface (the side--

Column 5, line 37, "arrow $\gamma$" should read --arrow r--

Signed and Sealed this

*Twenty-second* Day of *April 1986*

[SEAL]

*Attest:*

DONALD J. QUIGG

*Attesting Officer*

*Commissioner of Patents and Trademarks*